United States Patent [19]

Seeley

[11] 4,437,507

[45] Mar. 20, 1984

[54] MOLDING MACHINE

[76] Inventor: Robert J. Seeley, P.O. Box 4065, Elmira, N.Y. 14904

[21] Appl. No.: 292,034

[22] Filed: Aug. 11, 1981

[51] Int. Cl.[3] ..... B22C 15/08; B22C 25/00

[52] U.S. Cl. ..... 164/173; 164/180; 164/187

[58] Field of Search ..... 164/322–324, 164/180, 186, 187, 188; 64/172, 173, 192, 193

[56] References Cited

U.S. PATENT DOCUMENTS

| | | | |
|---|---|---|---|
| 3,628,592 | 12/1971 | Taccone | 164/187 X |
| 3,709,282 | 1/1973 | Taccone | 164/187 |
| 3,744,551 | 7/1973 | Gunnergaard | 164/187 X |
| 3,817,314 | 6/1974 | Deve | 164/187 X |
| 3,838,731 | 10/1974 | Abraham et al. | 164/187 X |

FOREIGN PATENT DOCUMENTS

| | | | |
|---|---|---|---|
| 547281 | 5/1977 | U.S.S.R. | 164/180 |

*Primary Examiner*—Kuang Y. Lin
*Attorney, Agent, or Firm*—Becker & Becker, Inc.

[57] ABSTRACT

A molding machine for producing molds. The machine includes a frame; a squeeze chamber assembly which is rotatably mounted in the frame and includes a squeeze chamber flask in which respective molds are produced; a first pattern mounting block associated with the squeeze chamber assembly and movable relative thereto and to the flask; a first pattern mounted on the first pattern mounting block and facing the flask; a mechanism associated with the squeeze chamber assembly for moving the first pattern mounting block relative to the flask and to the squeeze chamber assembly; a mechanism associated with the frame for rotating the squeeze chamber assembly relative to the frame; a second pattern mounting block operatively connected to the frame and movable relative thereto and into and out of the flask; a second pattern mounted on the second pattern mounting block and facing the flask; a mechanism associated with the frame and the second pattern mounting block for moving the second pattern mounting block relative to the frame and to the flask; and a sand blow chamber assembly having a blow chamber which is in communication with a source of sand and with the flask for supplying sand thereto.

7 Claims, 9 Drawing Figures

MOLDING MACHINE

The present invention relates to a molding machine, and in particular to a rotating flask-high pressure green sand molding machine for use in the foundry industry.

Molding machines in general are, of course, known. However, the heretofore known molding machines have numerous drawbacks. Specifically, these molding machines are large and cumbersome, and hence also quite expensive. To compound these drawbacks, and in part as a result thereof, the heretofore known molding machines operate fairly slowly.

It is therefore an object of the present invention to provide a molding machine which is faster and more efficient, yet is less expensive, less complicated, and structurally smaller than the heretofore known molding machines.

This object, and other objects and advantages of the present invention, will appear more clearly from the following specification in connection with the accompanying drawings, in which.

Figure 1:
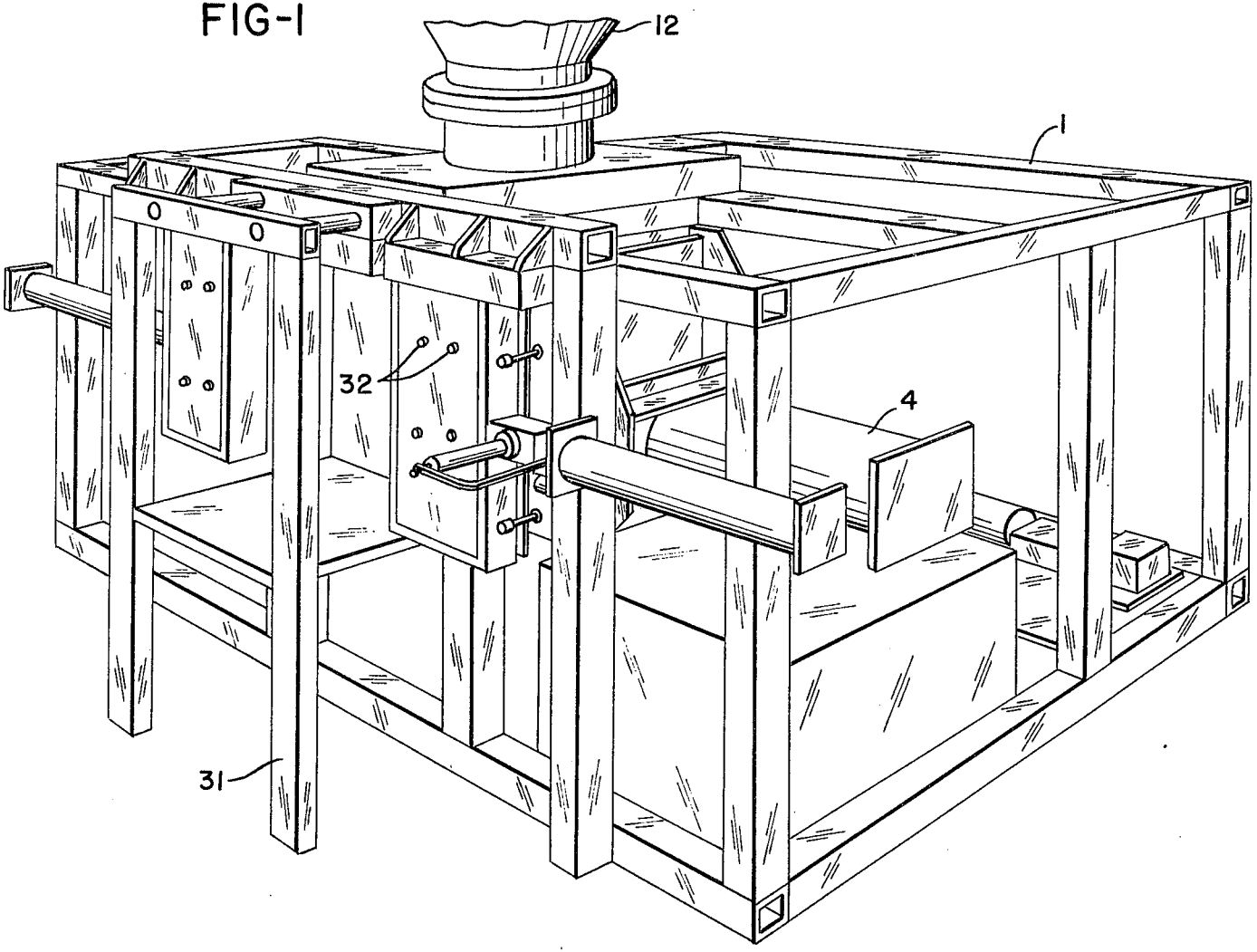
FIG. 1 is an overall perspective view of the inventive molding machine, which is provided with an adjoining core setter.

The molding machine of the present invention is characterized primarily by a frame; a squeeze chamber assembly which is rotatably mounted in the frame and includes a squeeze chamber flask in which respective molds are produced; a first pattern mounting block which is associated with the squeeze chamber assembly and is movable relative thereto and to the flask, this first pattern mounting block forming a first movable wall of the flask; a first pattern mounted on the first pattern mounting block and facing the flask; means associated with the squeeze chamber assembly for moving the first pattern and the first pattern mounting block relative to the flask and to the squeeze chamber assembly; means associated with the frame for rotating the squeeze chamber assembly, the first pattern mounting block, the first pattern, and the means for moving the same relative to the frame; a second pattern mounting block operatively connected to the frame and movable relative thereto and into and out of the flask so as to form a second movable wall of the flask remote from the first movable wall or first pattern mounting block; a second pattern mounted on the second pattern mounting block and facing the flask; means associated with the frame and the second pattern mounting block for moving the second pattern and the second pattern mounting block relative to the frame and to the flask; and a sand blow chamber assembly having a blow chamber which is in communication with a source of sand and with the flask for supplying sand thereto.

According to further preferred features of the inventive molding machine, the means associated with the squeeze chamber assembly for moving the first pattern and the first pattern mounting block may include a squeeze and ejection cylinder, and a piston displaceably mounted therein and operatively connected to the first pattern mounting block. The means associated with the frame and the second pattern mounting block for moving the second pattern and the second pattern mounting block may include a stationary squeeze cylinder, and a piston displaceably mounted therein and operatively connected to the second pattern mounting block. The means associated with the frame for rotating the squeeze chamber assembly may include a squeeze chamber rotation control cylinder, and a piston displaceably mounted therein and operatively connected to the squeeze chamber assembly for effecting rotation thereof relative to the frame.

The sand blow chamber assembly may include a filling tube for effecting communication of the blow chamber with the source of sand, this filling tube being provided with a sand feed control valve for controlling the flow of sand therethrough. The sand blow chamber assembly may further include; a conduit in communication with the blow chamber; a compressed air vent and pressure relief valve which is located in the conduit, this valve being selectively opened and closed; a blow pressure inlet tube which is in communication with a source of compressed air and with the blow chamber for supplying compressed air thereto; and a compressed air inlet valve which is located in the blow pressure inlet tube, this air inlet valve being selectively opened and closed.

The sand blow chamber assembly may also include at least one fluidization air injector tube which is in communication with a source of compressed air and with that vicinity of the blow chamber which leads to the flask for injecting pulsating blasts of air into this last mentioned region of the blow chamber for fluidizing sand located there.

The above described features of the present invention satisfy the aforementioned object. In particular, the novel structure of the inventive molding machine eliminates the need for having to produce molds in a single operational direction of movement, which necessitated the rather long machine length of the heretofore known molding machines. In contrast, the construction of the inventive molding machine allows for rotation of the flask, which contains the mold, by 90° relative to the remainder of the machine. As a result, the mold can be pushed out at right angles to the pattern mounting block which closes off the flask. Consequently, the structural size of the inventive molding machine can be considerably less than that of the heretofore known molding machines. In particular, whereas a heretofore known molding machine might require a 220 inch hydraulic stroke, only 150 inches is required with the inventive molding machine. As a consequence of this smaller structural size, the present invention molding machine is also less complicated and, hence, less expensive. The inventive molding machine is also able to run more efficiently and considerably faster than did the heretofore known molding machines. In particular, the molding machine of the present invention is able to operate up to 60% faster than could heretofore known molding machines, producting as many as 400 molds per hour.

Referring now to the drawings in detail, FIG. 1 schematically illustrates the molding machine frame 1, and shows the squeeze and ejection cylinder assembly 4, as well as the sand blow chamber assembly 12. Adjoining the molding machine frame 1 is a core setter 31, the cores 32 of which are intended for placement in finished molds as they leave the molding machine. It should be noted that this core setting can be accomplished simultaneously with the production of subsequent molds, yet without slowing down the overall mold production process.

FIGS. 2 through 9 show the molding machine in greater detail. In particular, reference numeral 2 designates the squeeze chamber assembly, and reference numeral 2a designates the squeeze chamber flask in which molds are formed. Reference numeral 3 designates the upper pivot and blow magazine assembly. The squeeze and ejection cylinder assembly 4 includes a piston 5 for applying pressure against the pattern mounting block or platen 8a of the squeeze chamber assembly 2. The squeeze chamber rotation control cylinder assembly 6 includes a piston 6a for effecting rotation of the squeeze chamber assembly 2 and the squeeze and ejection cylinder assembly 4. The stationary platen guide rod assembly is designated with the reference numeral 7, and the left hand (in the drawings) pattern mounting block or platen is designated by the reference numeral 8. Reference numerals 9 and 9a designate the patterns which are mounted to the respective pattern mounting blocks 8 and 8a, and which are to be used to give the mold the desired configuration. These patterns are, of course, changeable in conformity with the desired mold configuration required. The stationary squeeze cylinder 10 includes a piston 11 for exerting pressure upon the pattern mounting block 8 in order to move the left hand pattern 9 towards the squeeze chamber flask 2a.

On top of the molding machine is mounted a sand blow chamber assembly 12, the blow or charging chamber 13 of which is in communication with the squeeze chamber flask 2a. The blow chamber assembly 12 includes a blow pressure inlet tube 14, a compressed air inlet valve 15, a conduit 16, and a compressed air vent or pressure relief valve 17, with the inlet tube 14 being connected to a source of compressed air. Also included may be a throat fluidization air injection tube 18 which allows for sand fluidization. At the top of the sand blow chamber assembly 12 is a filling tube 12a which is connected to a source of sand, and in which is located a sand feed control valve 19 for controlling sand injection.

The inventive molding machine operates as follows, and preferably automatically by means of control circuitry which is not shown in detail in the enclosed drawings.

Figure 2:
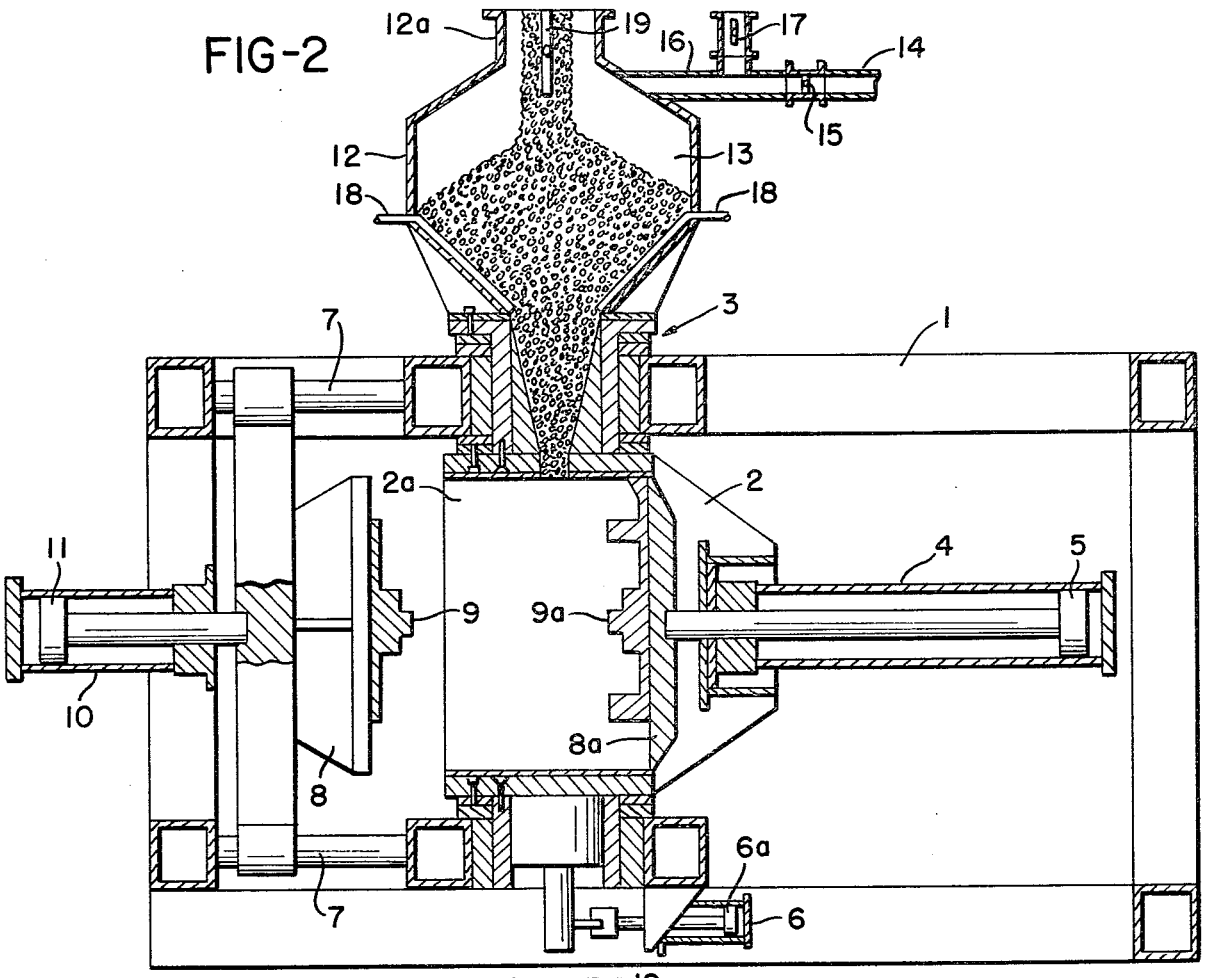
FIG. 2 is a partially sectioned front view of the inventive molding machine in its starting position, with the flask open and sand being introduced into the sand blow chamber assembly.

FIG. 2 shows the inventive molding machine in the starting position. The stationary squeeze cylinder 10, and the pattern mounting block or platen associated therewith, are in the open position. The blow or charging chamber 13 of the sand blow chamber assembly 12 is filled with sand at this time. For this purpose, the sand feed control valve 19 is opened to allow introduction of sand through the filling tube 12a, and the compressed air vent or pressure relief valve 17 is opened to allow air displaced by the sand to escape; the compressed air inlet valve 15 is closed during this phase of the operation. Until the charging chamber 13 is filled with sand, the molding machine will not proceed to the next step.

Figure 3:
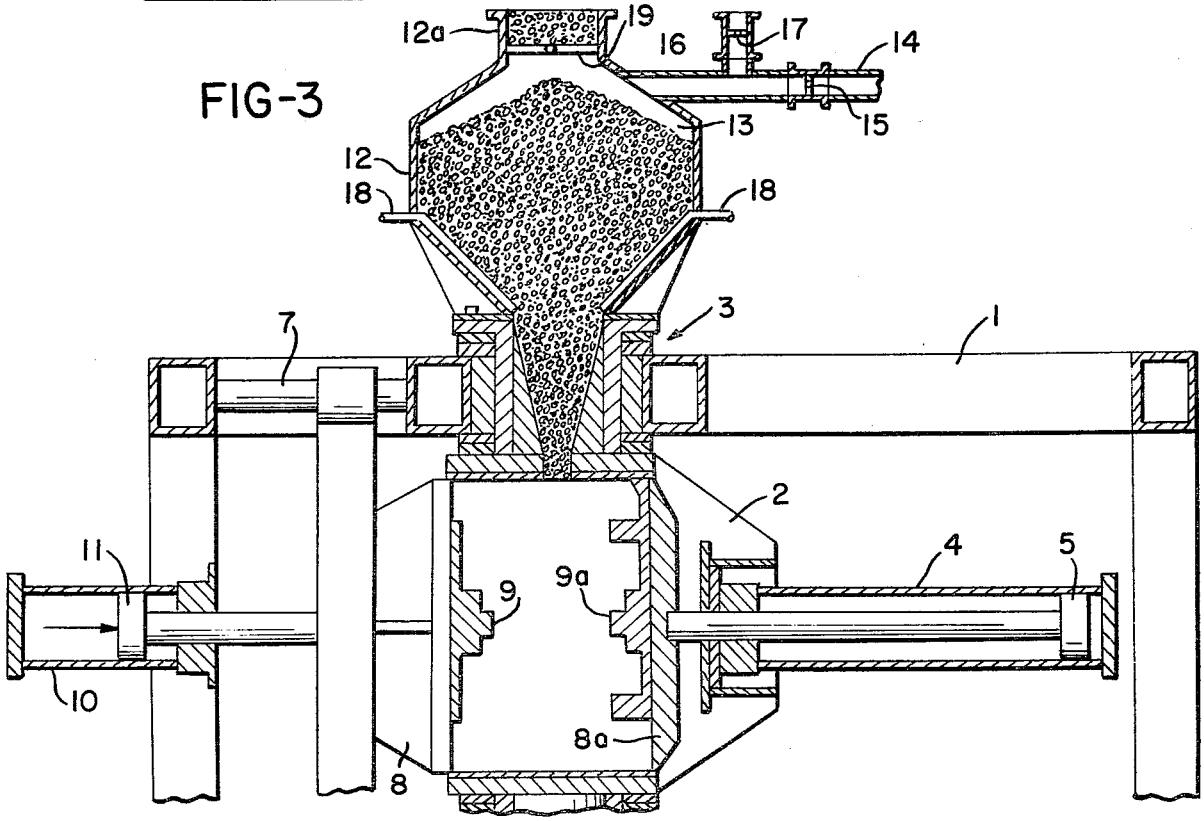
FIG. 3 is a partially sectioned view of the molding machine of FIG. 2 in the flask closing position.
Figure 4:
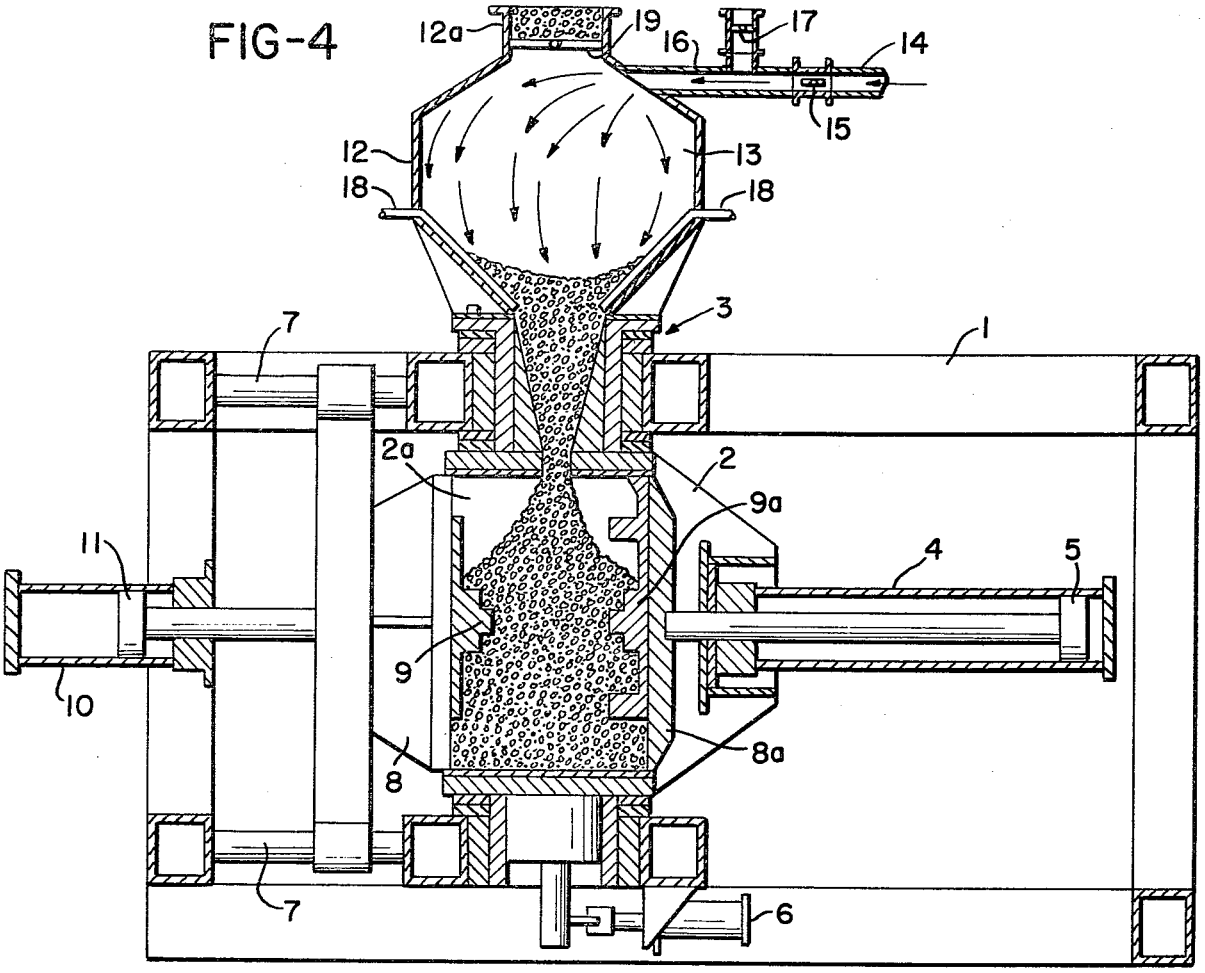
FIG. 4 is a partially sectioned view showing the molding machine during the flask filling step.

As soon as the charging chamber 13 has received the proper amount of sand, the sand feed control valve 19 closes the filling tube 12a (FIG. 3). The compressed air vent 17 is also closed in preparation for the next stage. The molding machine is now in condition for the flask closing step. In order to close the squeeze chamber flask 2a preparatory to introducing sand therein, the piston 11 of the stationary squeeze cylinder 10 is activated, thus pushing the pattern mounting block 8, with the pattern 9 mounted thereon, into the flask 2a. The pattern mounting block 8 and the pattern 9 are pushed into the flask 2a until the proper thickness of the mold which is to be produced is obtained. The squeeze chamber flask 2a is thus closed off, and the blow or charging chamber 13 is now sealed. The molding machine is now ready for the flask filling or blow step depicted in FIG. 4.

The compressed air inlet valve is now opened, allowing compressed air to flow through the blow pressure inlet tube 14 and the conduit 16 into the blow chamber 13 of the sand blow chamber assembly 12, thus pressurizing the chamber 13 and forcing the sand located therein into the squeeze chamber flask 2a. At the same time, pulsating blasts of air are injected into the throat of the chamber 13 through the air injector tubes 18 to fluidize the sand at the entrance into the flask 2a. This sand fluidization reduces potential blockage in the throat of the chamber 13, and ensures better filling of the flask 2a.

Figure 5:
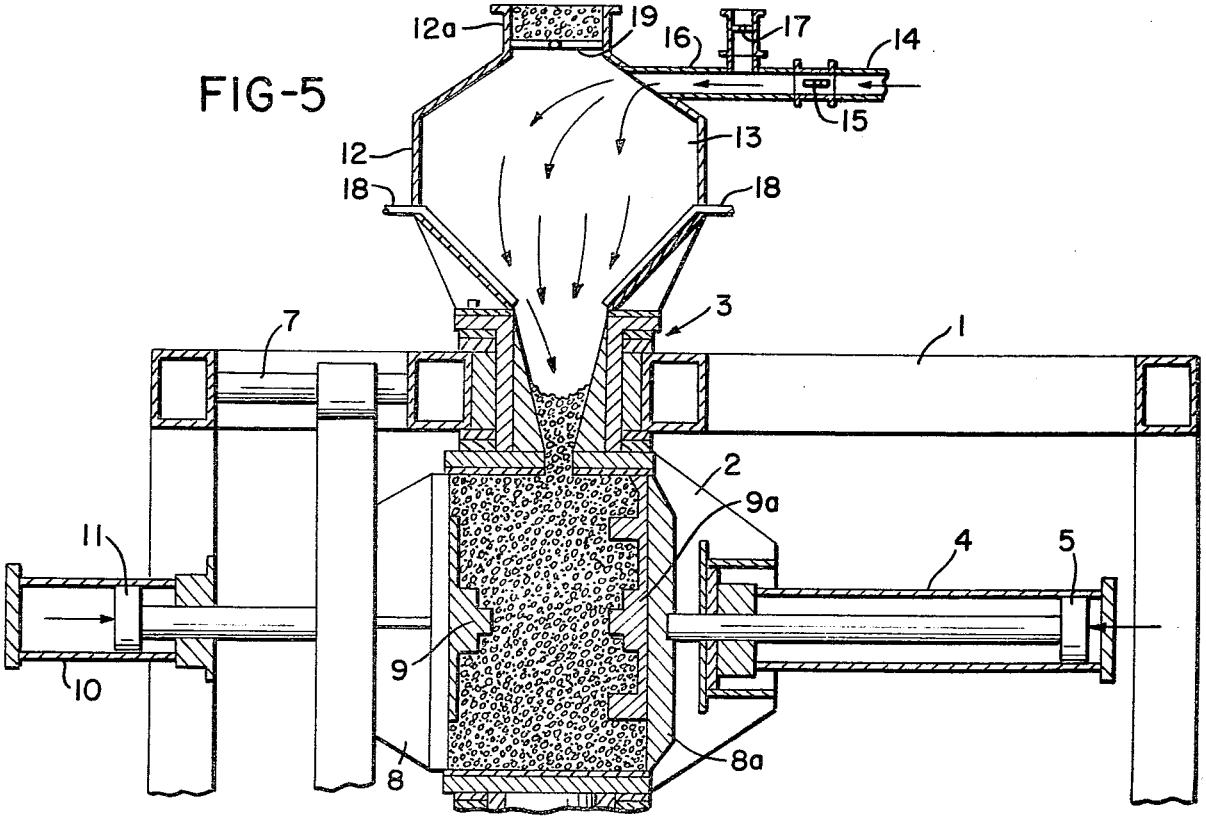
FIG. 5 is a partially sectioned view showing the molding machine during the squeeze step.

FIG. 5 illustrates the condition of the molding machine with the squeeze chamber flask 2a completely filled with sand in preparation for the subsequent squeeze step. Note that the compressed air inlet valve 15 continues to remain open, so that compressed air continues to flow into the charging chamber 13, preventing sand from backing up into the chamber 13 during the squeezing step.

The pistons 5 and 11 of the squeeze and ejection cylinder assembly 4 and the stationary squeeze cylinder 10 respectively are activated, thus applying pressure to the pattern mounting blocks 8 and 8a. Thus squeezes the sand in the squeeze chamber flask 2a, thus forming a mold 20. The pressure applied by the two pistons 5 and 11 is, of course, adjustable in order to obtain satisfactory mold definition and hardness in conformity with the respective requirements. As soon as the desired pressure is achieved, the pistons 5 and 11 are deactivated, and the next step of the cycle is initiated.

Figure 6:
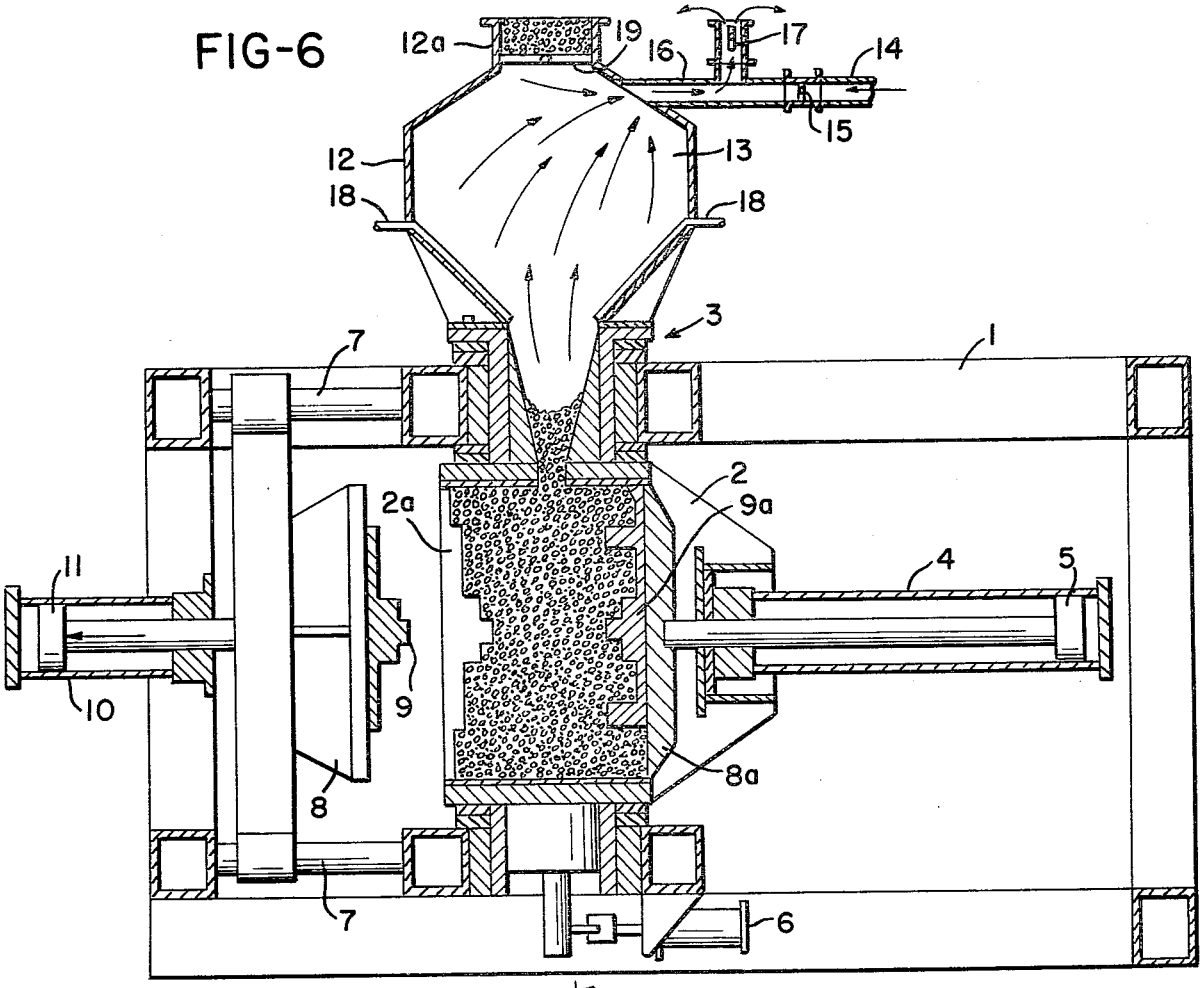
FIG. 6 is a partially sectioned view showing the molding machine during the flask opening step.
Figure 7:
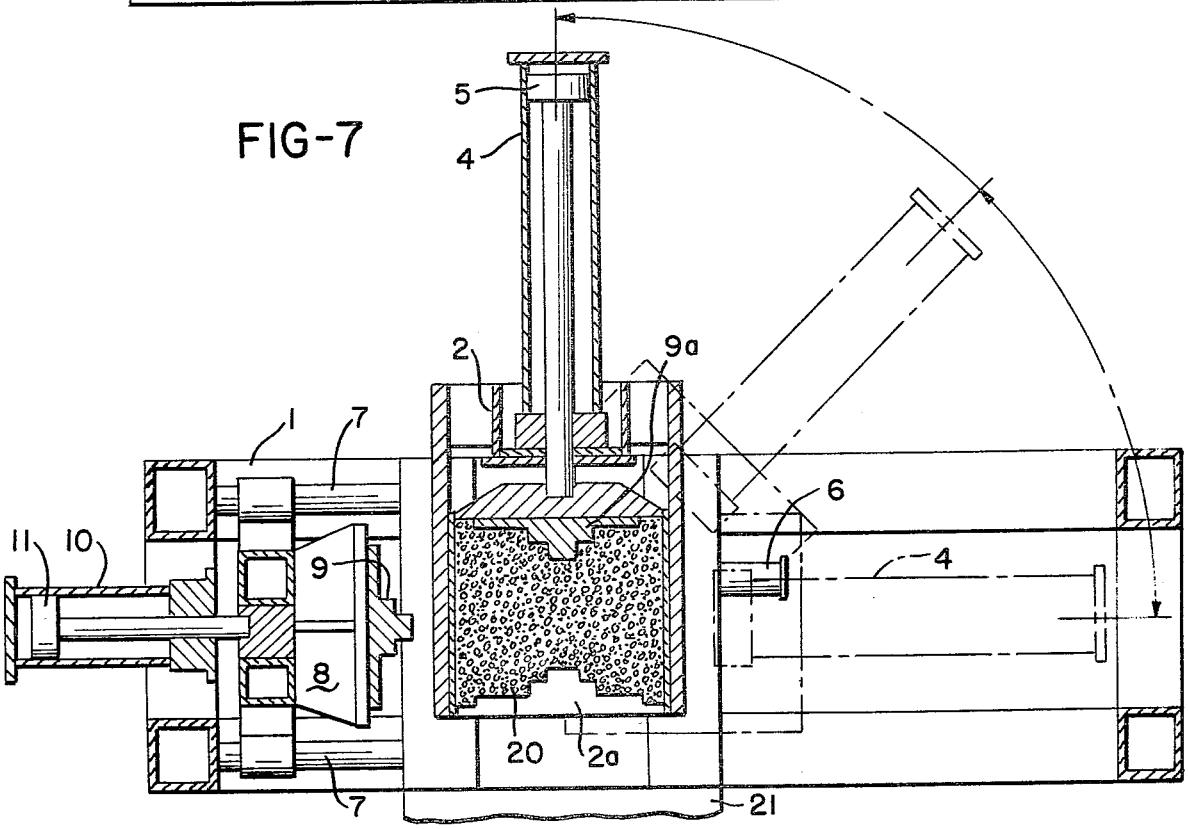
FIG. 7 is a plan view of the molding machine illustrating rotation of the flask.

The molding machine is now ready for flask opening (FIG. 6). The pistons 5 and 11 are activated for reverse movement, thus returning the piston 5 of the squeeze and ejection cylinder assembly 4, and the piston 11 of the stationary squeeze cylinder 10 to their starting positions, which is reflected in FIG. 2. In this position, the pattern 9 is well removed from the mold 20 in the flask 2a. At the same time, the compressed air inlet valve 15 is closed, and the compressed air vent or pressure relief valve 17 is opened, thus relieving the air pressure in the blow chamber 13 and reducing this air pressure to ambient pressure. The molding machine is now ready for flask rotation.

The piston 6a of the squeeze chamber rotation control assembly 6 is activated. Consequently, as shown in the plan view of FIG. 7, the squeeze and ejection cylinder assembly 4 is rotated from its position in alignment with the stationary squeeze cylinder 10, by 90° relative to the machine frame 1 and the pattern 9. Also rotated by 90° along with the squeeze and ejection cylinder assembly 4 are the squeeze chamber assembly 2, the pattern mounting block 8a and pattern 9a, the squeeze chamber flask 2a, and the mold 20 which is located in the flask 2a. In addition to the final rotated position of the squeeze and ejection cylinder assembly 4 and the squeeze chamber assembly 2 and flask 2a, FIG. 7 also shows in phantom the starting position (as in FIG. 6) prior to rotation, and an intermediate position during the rotation. After completion of the 90° rotation of the squeeze chamber assembly 2 relative to the frame 1, the molding machine is ready to eject or push off the mold 20 onto the mold discharge table 21.

Figure 8:
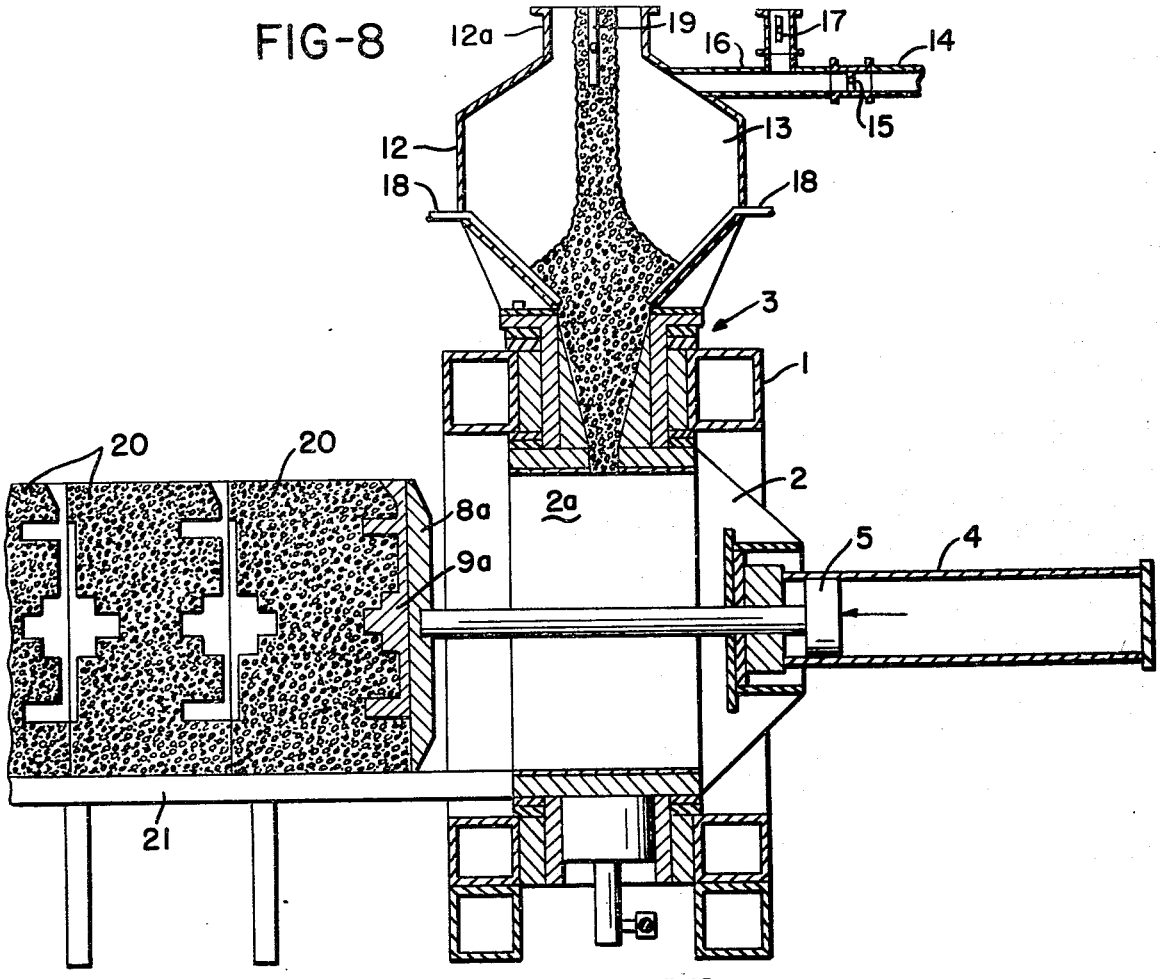
FIG. 8 is a partially sectioned end view showing the molding machine during the mold push-off step.

FIG. 8 depicts the mold push off procedure. The piston 5 of the squeeze and ejection cylinder assembly 4 is activated, thus applying pressure to the pattern mounting block 8a and pattern 9a and ejecting the mold 20 from the flask 2a. The mold 20 is pushed onto the mold discharge table 21 against the mold 20 ejected during the preceding mold push off cycle, thus moving the entire line of molds forward by the thickness of one mold 20.

As has been noted previously, the inventive molding machine makes it possible to go through an entire mold production cycle much faster than was heretofore possible. Part of the reason for this accelerated procedure, in addition to the shorter strokes needed by the pistons 5 and 11, which is made possible by the 90° rotation of the squeeze and ejection cylinder assembly 4 and the squeeze chamber flask 2a, is due to the fact that the sand filling step depicted in FIG. 2 is already initiated during the flask rotation and mold push off steps of FIG. 7 and 8 respectively. In particular, the sand feed control valve 19 and the pressure relief valve 17 are opened, allowing the charging chamber 13 to start filling with sand.

Figure 9:
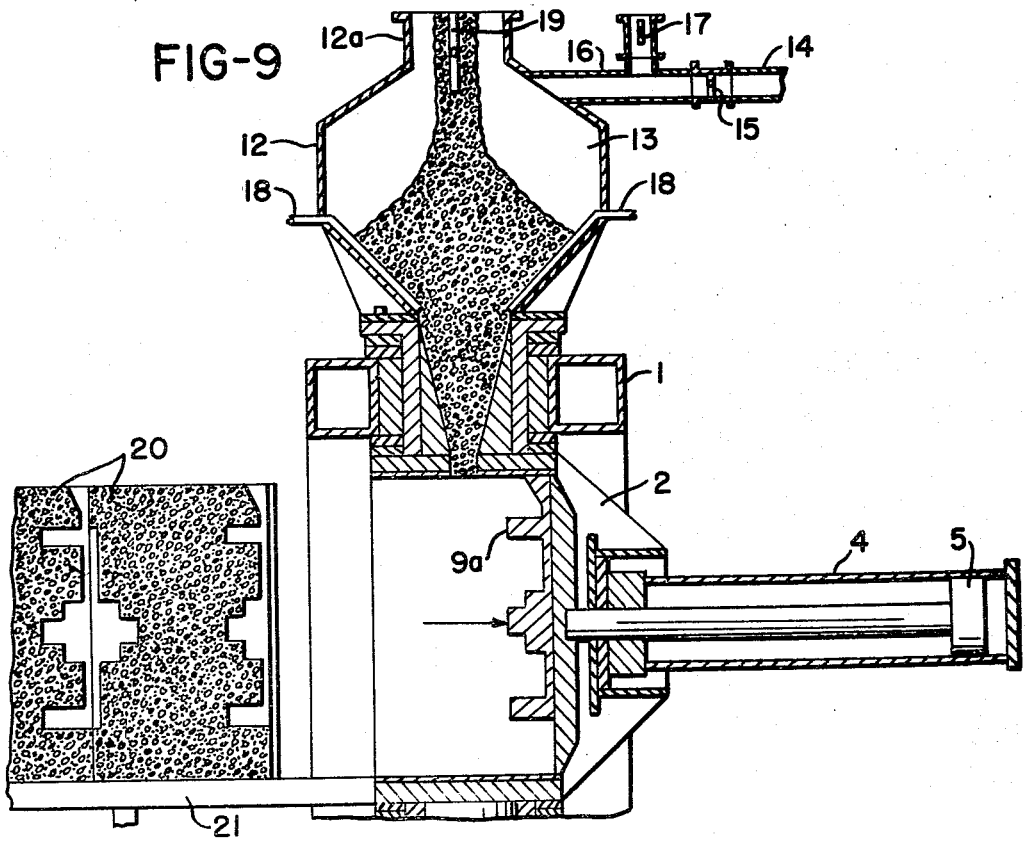
FIG. 9 is a partially sectioned end view showing the molding machine during return of the piston of the squeeze and ejection cylinder assembly in preparation for return to the starting position of FIG. 2.

As shown in FIG. 9, the piston 5 of the squeeze and ejection cylinder assembly 4 is activated for reverse movement, thus returning the right hand pattern 9a through the flask 2a to its starting position. At this point the piston 6a of the squeeze chamber rotation control assembly 6 is again activated for rotating the squeeze and ejection cylinder assembly 4, the squeeze chamber assembly 2, and the squeeze chamber flask 2a back to the starting position of the molding machine. Sand continues to fill the charging chamber 13, and the molding machine is now in the position of FIG. 2 in preparation for the flask closing depicted in FIG. 3.

In this disclosure of the drawings, the conduit 16 with its valve 17, and the inlet tube 14 with its valve 15, have all been shown as one unit in communication with the blow chamber 13. It is just as easily possible to have a separate conduit 16 and a separate inlet tube 14, which are then respectively in communication with the blow chamber 13.

The use of the word sand throughout the specification refers to green sand or foundry sand. An exemplary composition of such sand might be roughly 90% by weight sand, 5½ to 7½% by weight of a combination of clay (such as bentonite) and binder additive, and 2½ to 4½% by weight of water to activate the clay and binder to cause swelling. The composition and amount of the clay and binder additive combination are varied in conformity with the particular requirements of the mold which is to be produced. It should be noted that by manifolding the flask, utilizing the existing vent system, chemically bonded sands could also be used.

The present invention is, of course, in no way restricted to the specific disclosure of the specification and drawings, but also encompasses any modifications within the scope of the appended claims.

What I claim is:

1. A molding machine for producing molds, said machine comprising:

a frame;

a squeeze chamber assembly rotatably mounted in said frame, said squeeze chamber assembly including a squeeze chamber flask in which respective molds are produced;

a first pattern mounting block associated with said squeeze chamber assembly and movable relative thereto and to said flask, said first pattern mounting block forming a first movable wall of said flask;

a first pattern mounted on said first pattern mounting block and facing said flask;

means associated with said squeeze chamber assembly for moving said first pattern and said first pattern mounting block relative to said flask and to said squeeze chamber assembly;

means associated with said frame for rotating said squeeze chamber assembly, said first pattern mounting block, said first pattern, and said means for moving same relative to said frame;

a second pattern mounting block operatively connected to said frame and movable relative thereto and into and out of said flask so as to form a second movable wall of said flask remote from said first movable wall or first pattern mounting block;

a second pattern mounted on said second pattern mounting block and facing said flask;

means associated with said frame and said second pattern mounting block for moving said second pattern and said second pattern mounting block relative to said frame and to said flask; and a sand blow chamber assembly which is permanently connected with the squeeze chamber assembly, and has a blow chamber which is in communication with a source of sand and is in constant communication with said flask for supplying sand thereto.

2. A molding machine according to claim 1, in which said means associated with said squeeze chamber assembly for moving said first pattern and said first pattern mounting block includes a squeeze and ejection cylinder, and a piston displaceably mounted therein and operatively connected to said first pattern mounting block.

3. A molding machine according to claim 2, in which said means associated with said frame and said second pattern mounting block for moving said second pattern and said second pattern mounting block includes a stationary squeeze cylinder, and a piston displaceably mounted therein and operatively connected to said second pattern mounting block.

4. A molding machine according to claim 3, in which said means associated with said frame for rotating said squeeze chamber assembly includes a squeeze chamber rotation control cylinder, and a piston displaceably mounted therein and operatively connected to said squeeze chamber assembly for effecting rotation thereof relative to said frame.

5. A molding machine according to claim 4, in which said sand blow chamber assembly includes a filling tube for effecting said communication of said blow chamber with said source of sand, said filling tube being provided with a sand feed control valve for controlling the flow of sand therethrough.

6. A molding machine according to claim 5, in which said sand blow chamber assembly further includes:

a conduit in communication with said blow chamber;

a compressed air vent and pressure relief valve located in said conduit, said valve being selectively opened and closed:

a blow pressure inlet tube in communication with a source of compressed air and with said blow chamber for supplying compressed air thereto; and a compressed air inlet valve located in said blow pressure inlet tube, said air inlet valve being selectively opened and closed.

7. A molding machine according to claim 6, in which said sand blow chamber assembly also includes at least one fluidization air injector tube in communication with a source of compressed air and with that vicinity of said blow chamber leading to said flask for injecting pulsating blasts of air into said last mentioned vicinity of said blow chamber for fluidizing sand located there.

* * * * *